United States Patent [19]

Spezial et al.

[11] Patent Number: 4,733,782

[45] Date of Patent: Mar. 29, 1988

[54] VENDING MODULE HAVING A SELECTABLE CONFIGURATION AND A WIRE HOOK ADAPTOR

[75] Inventors: Ronald J. Spezial, RiverVale; William Prendergast, Park Ridge, both of N.J.

[73] Assignee: Trans-World Manufacturing Corporation, East Rutherford, N.J.

[21] Appl. No.: 938,642

[22] Filed: Dec. 5, 1986

[51] Int. Cl.[4] ..... A47F 5/08

[52] U.S. Cl. ..... 211/57.1; 211/87; 248/220.4

[58] Field of Search ..... 211/57.1, 59.1, 87; 248/220.2, 220.3, 220.4, 221.1, 221.2

[56] References Cited

U.S. PATENT DOCUMENTS

| | | | |
|---|---|---|---|
| 3,976,201 | 8/1976 | Hodgson et al. | 248/220.4 X |
| 4,029,282 | 6/1977 | Dauth | 248/221.1 |
| 4,606,466 | 8/1986 | Frederickson | 211/59.1 |
| 4,610,413 | 9/1986 | Pedersen | 248/220.4 X |
| 4,615,503 | 10/1986 | Garfinkle | 248/220.3 X |

*Primary Examiner*—Robert W. Gibson, Jr.

*Attorney, Agent, or Firm*—Ostrolenk, Faber, Gerb & Soffen

[57] ABSTRACT

A standard retailing case having a back panel with a plurality of support holes therein and with vertical dividers and the horizontal shelves having hooks which interlock with the support holes is further provided with an adaptor. The adaptor is provided with the hooks that enable it to be connected to the back panel of the case and along a front panel of the adaptor with a plurality of circular holes that receive conventional wire hooks which are suitable for hanging thereon retail merchandise having hang holes which allow the merchandise to be hung on the wire hooks.

18 Claims, 11 Drawing Figures

FIG. 4A.
PRIOR ART
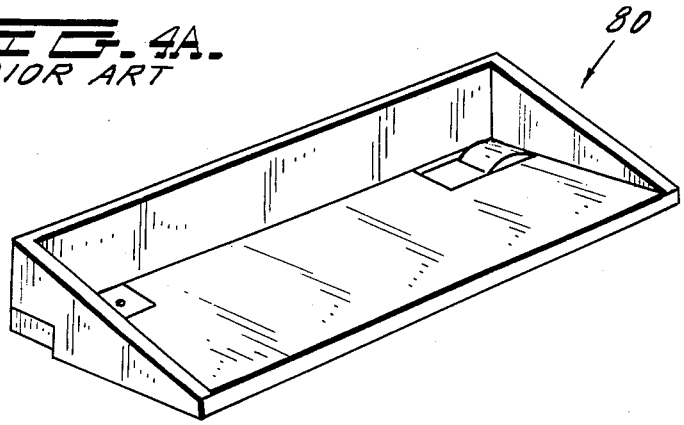
FIG. 4B.
PRIOR ART
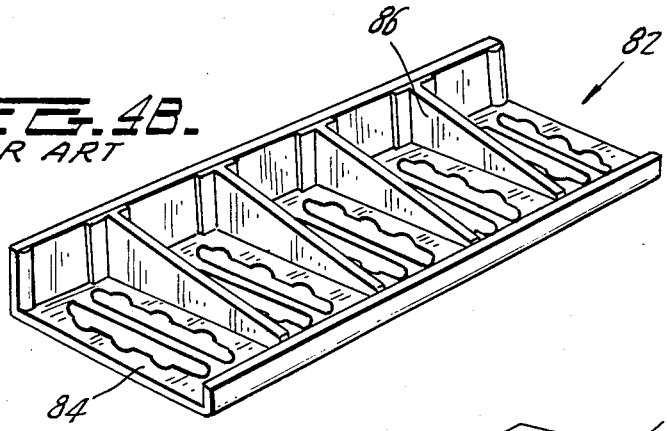
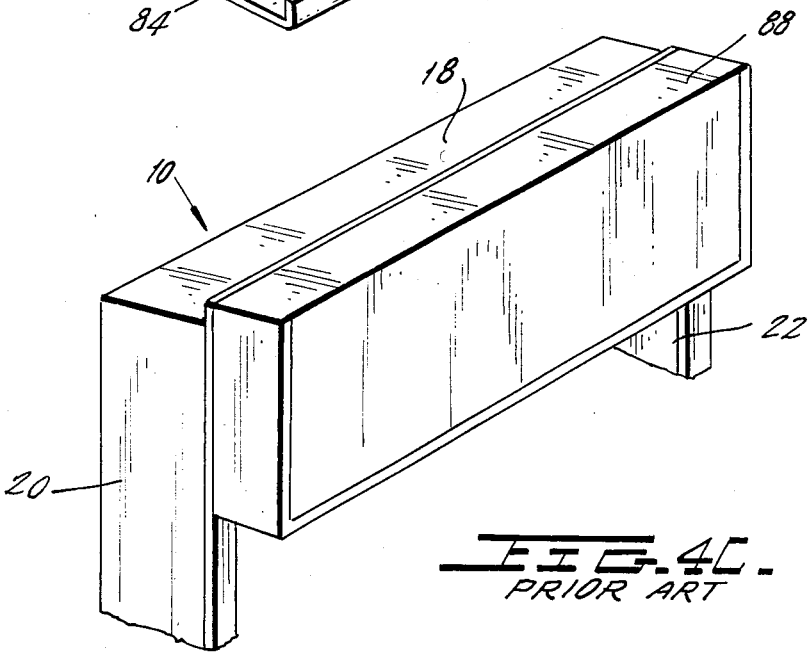
FIG. 4C.
PRIOR ART

VENDING MODULE HAVING A SELECTABLE CONFIGURATION AND A WIRE HOOK ADAPTOR

BACKGROUND OF THE INVENTION

The present invention is directed to a vending case for storing therein small stackable retail items and, more particularly, to a flexible, cabinet-shaped module with hardware accessories which allow the retailer to configure the case to provide both variously sized storage bin and shelf space and/or a wire hook hanging area for supporting hangable items on wire hooks.

Small stackable items such as cigarettes and the like are often displayed in and dispensed from relatively small open cases which contain horizontally extending shelves and vertical dividers to provide in the case variously sized and readily accessible bins for holding the stackable items therein.

Manufacturers, such as Trans World Manufacturing Company, the assignee herein, have been supplying for some time modular cases in kit form which the merchandiser can assemble to obtain the variously sized bin and shelf space. Optional attachments for the modular case include items such as a header for displaying information at the top of the case, a specially shaped bottom shelf, a so-called front face open shelf and other various accessories.

The basic components of this known case are illustrated in FIGS. 1–4 and will be described in greater detail later herein. For the present it suffices to note that the case comes with a back panel which contains a plurality of specially shaped support holes arranged in a predetermined order. The accessories such as the vertical dividers etc., are formed with generally L-shaped hooks which are sized and spaced from each other to enable their insertion in the support holes to assure safe and secure attachment of the accessories to the back panel of the modular case.

As noted above, the bin and shelf space provided by this known device is quite useful for storing and displaying stackable items such as cigarettes and the like. It is not, however, optimized or useful for supporting the numerous small items which come with a hang hole in their packaging by which the items are intended to be hung on conventional and standardized wire hooks which are familiar to most shoppers.

The wire hooks have an elongated, rather stiff, stem on which several of the packages may be hung and a prong arrangement which enables the wire hooks to be removably inserted into a vertically extending peg board. The peg board contains numerous and closely spaced prong receiving circular support holes.

In contrast to the support holes for the standard wire hooks which are circular and closely spaced, the support holes in the back panel of the modular cases for the stackable items are peculiarly shaped and specifically spaced to receive the special hooks disposed on the conventional accessories for the modular case. To date such cases have not been supplied with means for supporting wire hooks therein and the alternative of stacking the hangable items in such cases is impractical and unattractive.

Although its advantages are many, the prior art has not realized to date the benefits to be gained from providing merchants with the ability to use standard wire hooks in existing cases which otherwise presently support only bin and shelf hardware.

SUMMARY OF THE INVENTION

Accordingly, it is the object of the present invention to provide a retailing display case having shelf and bin space and/or wire hook hanging space.

It is another object of the present invention to provide a retailing case with an easily changeable bin and shelf configuration.

It is another object of the present invention to provide a removable adaptor which can be secured to the back panel of the retailing case and which is effective for supporting a plurality of wire hooks thereon.

The foregoing and other objects of the invention are realized with a modular case which includes a back panel containing a plurality of spaced mounting holes which are suitable for receiving and supporting various shelving accessories and which enable a user to create bin and shelf space in a desired configuration. The flexibility of the modular case is further enhanced with the inclusion of an adaptor having on one side thereof hook means which enable the adaptor to be secured to the back panel and in spaced relation to the hook means a front panel containing a plurality of holes which are suitable for receiving and supporting conventional wire hooks.

In a preferred embodiment, the adaptor is formed of a single molded piece having a front plate with the plurality of wire hook receiving holes located thereon, a rear plate which is spaced from the front plate and connected thereto by several ribs or tabs which are spaced from one another and arranged so as not to interfere with the location of the wire hook holes, and several hooks on the rear plate which have the shape and spacing to fit and to be secured in mounting holes of the modular case.

The modular case may include several adaptors which are vertically spaced from one another to create several rows of hanging space. It is also possible to populate the modular case with one or more of the foregoing adaptors in combination with the known shelving accessories to create any desired case configuration. Thus, the adaptor provides the ability to create in the same modular case both shelving and hanging space in any desired ratio and tailored to meet the specific needs of the user.

Other features and advantages of the present invention will become apparent from the following description of the invention which refers to the accompanying drawings.

BRIEF DESCRIPTION OF THE DRAWINGS

FIGS. 4A–4C provide several sketches of conventional accessories that can be used in conjunction with the case of FIG. 1A.

DETAILED DESCRIPTION OF THE INVENTION

Figure 1A:
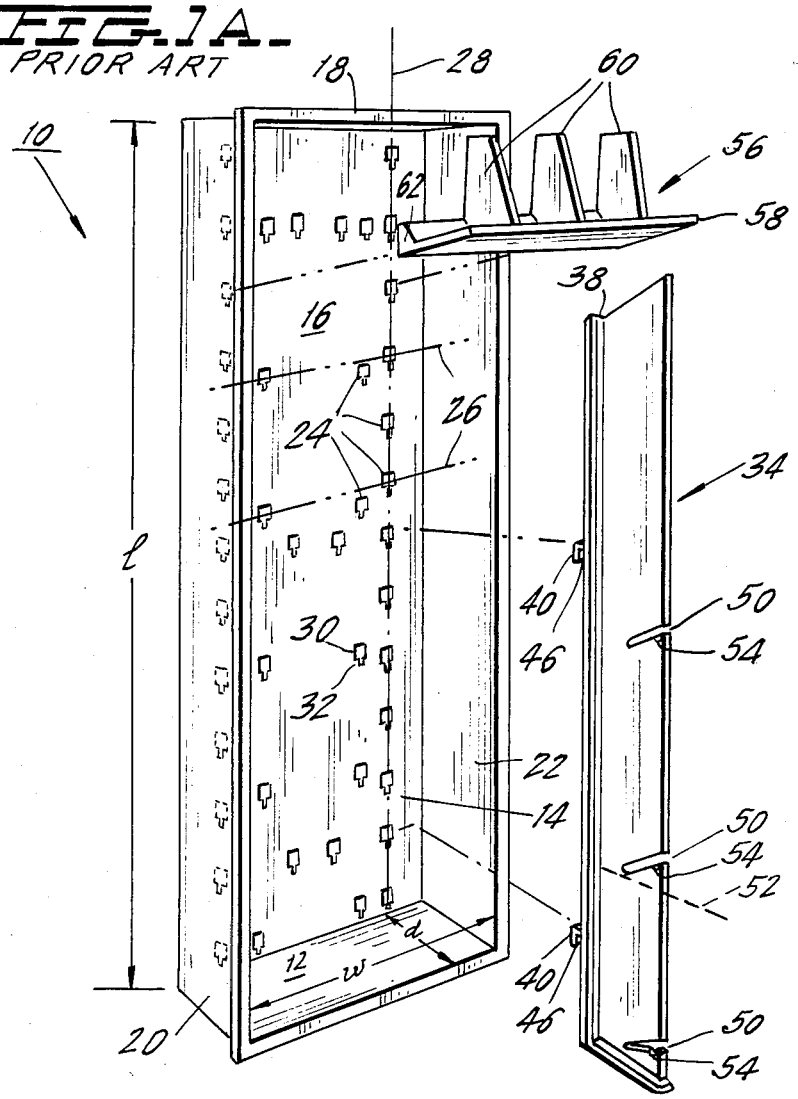
FIG. 1A PRIOR ART
FIG. 1A illustrates perspectively a basic prior art module for a retailing case and a vertical divider therefor.
Figure 1C:
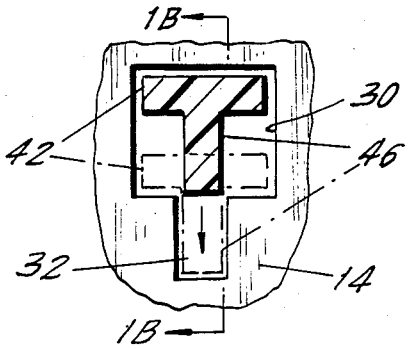
FIG. 1C PRIOR ART
FIGS. 1B–1C illustrate the manner in which the hooks provided on the accessories for the module of FIG. 1A are secured to the module.
Figure 1B:
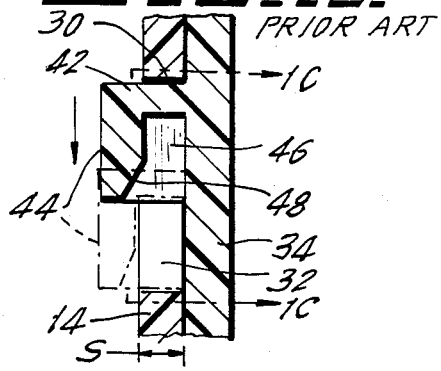
FIG. 1B PRIOR ART

FIGS. 1–4 illustrate a known retailing display case. Case 10 of FIG. 1 comprises a basic module 12 defining a generally rectangular space 14 located between a back panel 16, top wall 18, bottom wall 20 and side walls 20 and 22. The size of module 12 is not specially relevant but it is worth noting that one existing line of such cases is available in a width "w" measured between side walls 20, 22 of about 12 inches, a length "l" which may be 24 or 29 inches and a depth "d" of about 4 inches.

Back panel 16 contains a plurality of support holes 24 arranged both along horizontal lines 26 and vertical lines 28. Each support hole 24 has a main generally square opening 30 and a downwardly depending slot 32 whose function will become apparent later herein.

Each one of a plurality of vertical dividers such as divider 34 is preferably comprised of a molded piece and includes a divider panel 36, extending perpendicularly to a relatively narrower base 38, and two or more hooks 40.

Any one of hooks 40 contains (FIGS. 1B, 1C) a top 42 which extends perpendicularly to back panel 16 , a downwardly depending lip 44 and a stiffening and positioning web 46 located centrally with respect to a lip 44 and top 42 as shown. The distal edge 48 of lip 44 is tapered to provide a larger clearance that facilities sliding of hook 40 down, over and behind back panel 16 thereby to secure the given accessory to the back panel. The spacing "s", in FIG. 1B, of lip 44 is about equal to the thickness of back panel 16.

Dividers 34 and other accessories for module 12 are provided with the above-described hooks 44. Hooks 44 enable the dividers and the various accessories to be secured to back panel 16 of case 10. The hooks 40 are aligned with and then inserted into the larger sized main openings 30 of mounting holes 24 provided in back panel 16. They are then pulled downwardly such that web 46 of hook 40 slides into slot 32 of mounting holes 24. Thereby, the dividers and accessories will become interlocked with and secured to back panel 16 of module 10.

Main panel 36 of divider 34 is provided with several slots 50 which are inclined to the horizontal 52 and which further contain a notch 54. The slots 50, as will become apparent shortly, receive various shelves which are illustrated in FIG. 2.

FIG. 1 further illustrates one of the accessory items for module 10 namely a so-called three wing feed shelf 56. It contains a base 58 and several dividers 60 and is preferably of molded construction. Hooks (not shown) of the type previously described are provided on the back surface (not shown) of a base 62 which is inclined to the major plane of base 58. Consequently, upon securing shelf 56 to back panel 16, the base 58 is inclined at a small acute angle and items stored on shelf 56 will not slide off.

Figure 2:
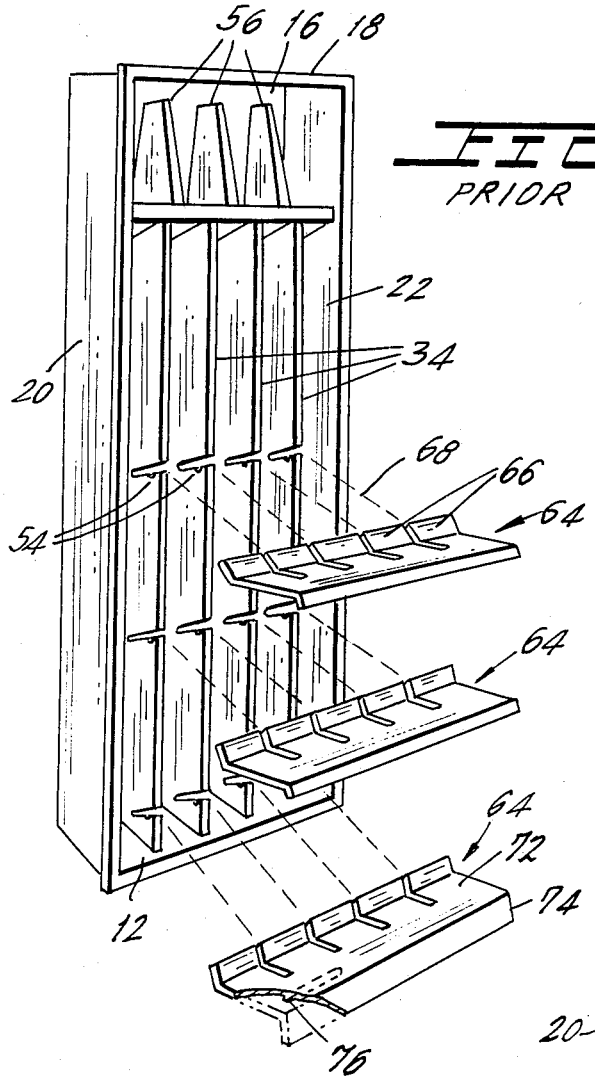
FIG. 2. PRIOR ART
FIG. 2 illustrates the module of FIG. 1A with additional horizontal shelves.
Figure 3:
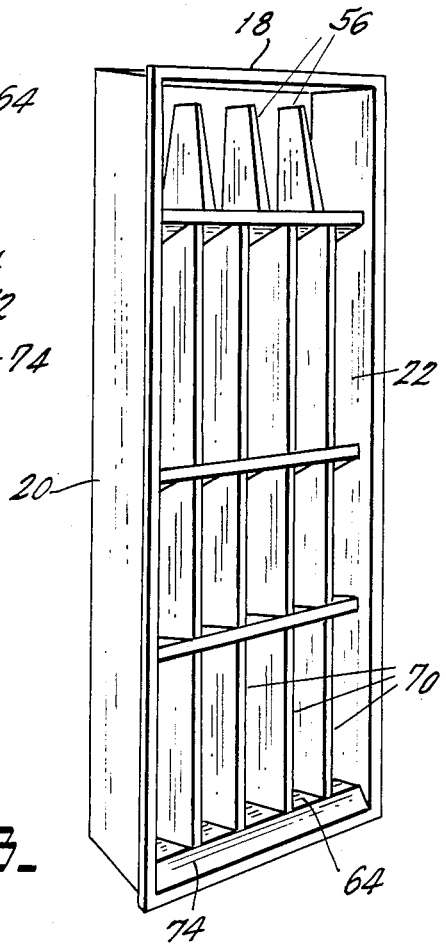
FIG. 3. PRIOR ART
FIG. 3 shows the case of FIG. 1A in its assembled form.

FIG. 2 illustrates several horizontal dividers or shelves 64 each of which is formed with slots 66 which, as indicated by dotted lines 68, allow shelves 64 to be supported by and to interlock with vertical dividers 34 to provide a plurality of bins 70 which may be seen in FIG. 3. FIG. 2 also illustrates a bottom shelf 72 which is similar to horizontal shelves 64 but which contains a large lip 74 which conceals and provides a finish over the bottom region of case 10.

Along the bottom surface of any of the foregoing shelves there appears several raised locking ribs 76 which snap into notches 54 of dividers 34 to firmly integrate the shelves and the dividers to each other. The integrated and thus assembled case is seen in FIG. 3.

Other accessories for module 12 are illustrated in FIGS. 4A–4C. FIG. 4A portrays a carton load shelf set 80. FIG. 4B shows a so-called front face shelf set 82 which contains a base 84 and several triangular dividers 86, providing a shelf generally similar to feed shelf 56 of FIG. 1A. A header 88 secured along the top of case 10 provides an information display center as well as a finish over the top of the case as illustrated in FIG. 4C. Preferably header 88 is hingedly secured to case 10 by hinges (not shown) which enable header 88 to swing upwardly to provide access to the space directly thereunder.

With the above described accessories, module 12 is configurable to provide both bin and shelf space. The case is not, however, suited for or capable of supporting conventional wire hooks.

Figure 5:
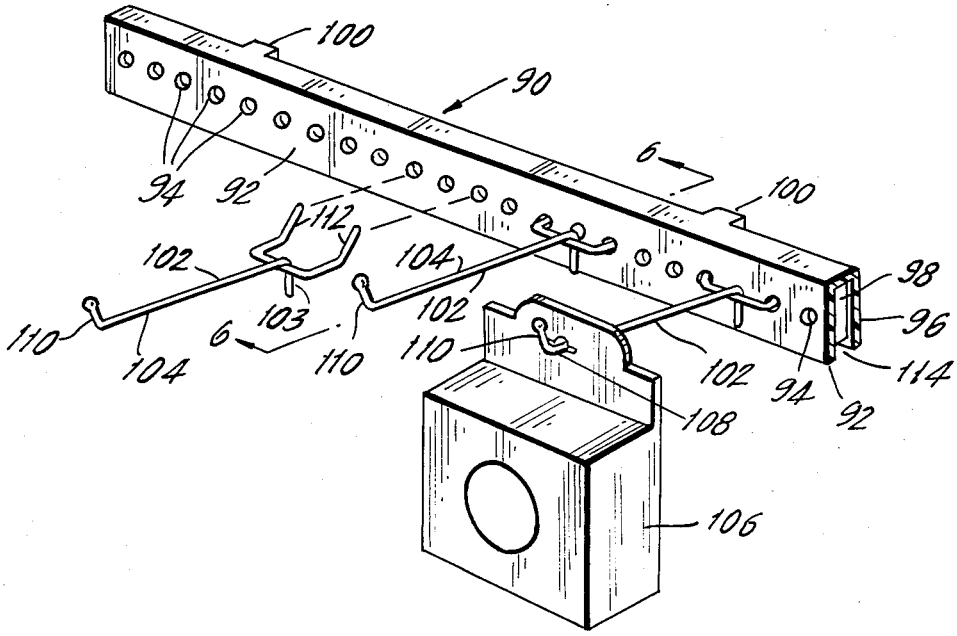
FIG. 5 illustrates perspectively a novel wire hook adaptor in accordance with the present invention for the case of FIG. 1A.
Figure 6:
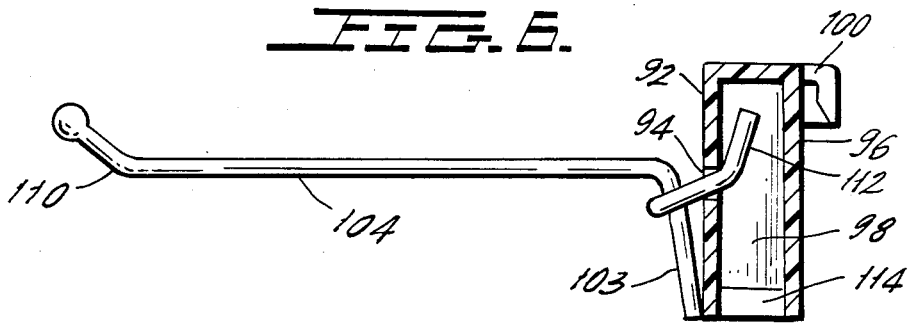
FIG. 6 is a cross-section of the adaptor of FIG. 5 along line 6—6.
Figure 7:
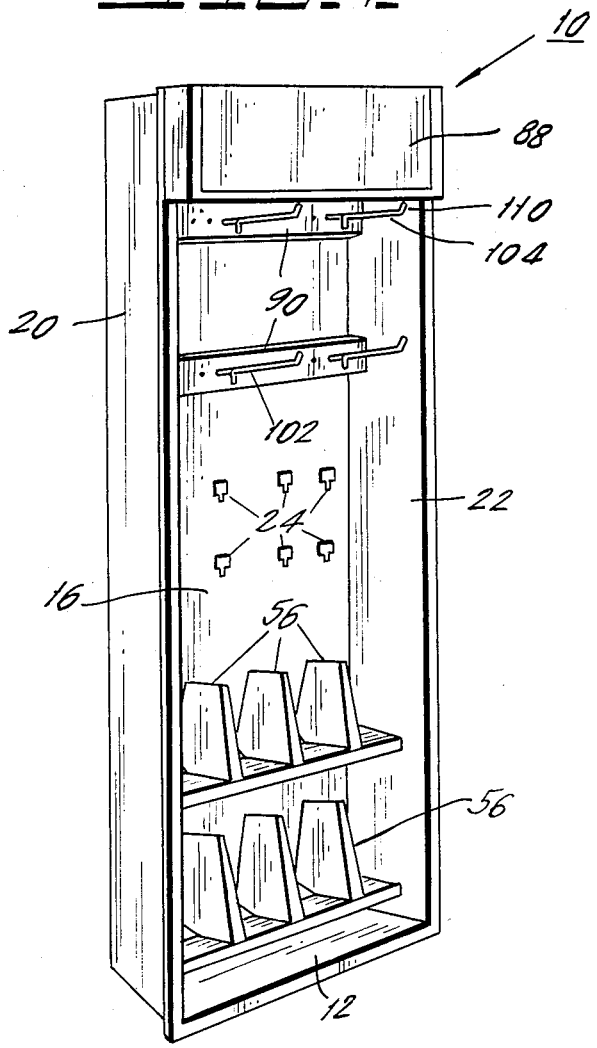
FIG. 7 illustrates the module of FIG. 1A which is provided with both several of the novel adaptors and other conventional accessories.

The present invention provides, as depicted in FIGS. 5–7, an adaptor 90 having a generally rectangular transverse cross-section (FIG. 6) and including a front plate 92 containing a line of circular holes 94, a rear plate 96 spaced from front plate 92 and connected thereto by spacer tabs 98, and hooks 100 which are identical to hooks 40 previously described in relation to FIG 1A.

The spacing and size of circular holes 94 is specifically selected to enable adaptor 90 to receive and support a plurality of wire hooks 102. Each wire hook includes a rigid stem 104 on which to hang items 106 having hang hole 108. An upwardly bent end 110 of wire hook 102 prevents the items 106 from falling off. Prongs 112 of wire hook 102 are insertable into circular holes 94 to thereby removably lock the wire hook in adaptor 90. Wire hook 102 remains horizontal as it is anchored against front plate 92 by anchor 103 of wire hook 102. Adaptor 90 is itself removably securable in back panel 16 of case 10 as its hooks 100 have the shape and spacing of hooks 40 provided on the conventional accessories for case 10.

The cross sectional view of FIG. 6 depicts prong 112 in position in the space 114 provided between front and rear plates 92 and 96 of adaptor 90. Note one of the spacer tabs 98 which is shown in FIG. 6 behind prong 112.

Adaptor 90 may span the width of case 10 or any portion thereof. In any configuration, the adaptor provides another option in configuring case 10. FIG. 7 illustrates one exemplary combination of adaptors with other accessories. But clearly any combination of accessories with one or more adaptors is contemplated. The invention enables the user to design or reconfigure, at any time, a case style which is fully populated by adaptors and wire hooks or adaptors in combination with the previously described standard accessories for case 10.

Although the present invention has been described in relation to a specific embodiment thereof many other variations and modifications will now become apparent to those skilled in the art. It is therefore preferred that the present invention be limited and not by the disclosure herein but only by the appended claims.

What is claimed is:

1. An interface adaptor for enabling mounting of wire hooks in a back panel of an article-supporting case, said wire hooks being of the type which are suitable to be mounted solely in wire hook mounted holes of predetermined size and spacing, said back panel being of the type which lacks said wire hook mounting holes and having instead back panel mounting openings each of which is formed of a main hook opening and a centering slot which depends downwardly from said main hook opening, said interface adaptor comprising:

a planar front plate having a plurality of said wire hook mounting holes for insertion of the wire hooks thereinto;

back panel hook means for connecting said interface adaptor to said back panel of said case, said hook means comprising a plurality of hooks each of which includes a top plate, a lip which depends downwardly from said top and a web located generally centrally with respect to said top and said lip, said web being receivable in the slot of the back panel mounting openings; and spacer and connecting means for connecting said back panel hook means to said front plate and for spacing said hook means from said front plate to provide a space between said back panel and said front plate, the wire hooks being supported exclusively by said front plate and being partially disposed in the space between the back panel and the front plate.

2. A vending display and dispensing case, comprising:

a plurality of wire hooks, each of said wire hooks having a stem for hanging an article thereon, an upwardly-bent prong means disposed at a mounting end of said stem, and an anchor disposed adjacent said prong means, said prong means being especially suitable for being inserted into peg-board-style support holes which are sized to fit said upwardly-bent prong means;

a back panel having a plurality of attachment means spacedly disposed over said back panel, said attachment means being suitable for securing shelving accessories to said back panel, said attachment means being of the type which are unsuitable for receiving and directly supporting said wire hooks; and at least one wire-hook-to-back panel interface adaptor, said interface adaptor including a front plate having a plurality of said peg-board-style support holes which are suitable for supporting said wire hooks therein, said front plate having a front face and a rear face and said prong means being anchored against said rear face and said anchor being supported against said front face of said front plate, said interface adaptor further including back plane hook means connected to said front plate and effective for securing said adaptor to said back panel at said attachment means of said back panel, and means for spacing said back panel from said front plate of said adaptor to provide a space between said front plate and said back panel for said prong means.

3. The adaptor of claim 1, wherein said wire hook mounting holes are arranged along a horizontal line.

4. The adaptor of claim 1, in which said space and connecting means comprises a rear plate and a plurality of tabs connecting said front and rear plates to one another, said hook means being located on said rear plate.

5. The adaptor of claim 4, in which the plurality of back panel mounting openings have an opening shape and spacing which is unsuitable for mounting thereinto said wire hooks and wherein said hook means comprises a plurality of L-shaped hooks which are receivable and securable in said back panel mounting openings.

6. The adaptor of claim 5, in which said hook means includes first and second ones of said L-shaped hooks.

7. A vending case as in claim 2, wherein said wire hook mounting holes of said adaptor are arranged along a horizontal line.

8. A vending case as in claim 2, in which said spacing means comprises a rear plate and a plurality of tabs connecting said front and rear plates of said adaptor to one another, said back plane hook means being located on said rear plate.

9. The vending case of claim 8, in which said attachment means of said back panel comprises a plurality of back panel mounting openings having an opening shape and spacing which is unsuitable for supporting said wire hooks and wherein said hook means of said adaptor are receivable and securable in said back panel mounting holes.

10. A vending case as in claim 2, further comprising vertical dividers and horizontal shelves for defining bins in said case.

11. The vending case of claim 7, further comprising a bottom horizontal shelf having an enlarged and downwardly depending lip, said bottom shelf being located along a bottom region of said case.

12. A vending case as in claim 2, further comprising said shelving accessories for said case, said shelving accessories being effective for providing bin and shelf space in said case.

13. The vending case of claim 12, in which said accessories include a header to be located along a top region of said case for displaying information thereon.

14. The vending case of claim 12, in which said accessories include a feed shelf having a horizontally extending base and a plurality of vertical dividers extending perpendicularly to the major plane of said base and being integral therewith.

15. The vending case of claim 12, in which said accessories include a carton load shelf set.

16. The vending case of claim 12, in which said accessories include a front face shelf set.

17. The vending case of claim 2, further comprising a plurality of adaptors, each of said adaptors having the construction of said at least one adaptor.

18. The vending case of claim 2, further comprising a frame for said back panel of said case, said frame having a top wall, a bottom wall, and first and second side walls.

* * * * *